United States Patent [19]

Prade

[11] 4,100,870

[45] Jul. 18, 1978

[54] SURFBOARD

[75] Inventor: Ernstfried Prade, Nijmegen, Netherlands

[73] Assignee: Mistral Windsurfing AG, Zurich, Switzerland

[21] Appl. No.: 783,845

[22] Filed: Apr. 1, 1977

[30] Foreign Application Priority Data

Apr. 1, 1976 [DE] Fed. Rep. of Germany ... 7610087[U]
Mar. 10, 1977 [DE] Fed. Rep. of Germany ... 7707436[U]

[51] Int. Cl.[2] ..... B63H 9/04

[52] U.S. Cl. ..... 114/39; 9/310 E; 9/2 S

[58] Field of Search ..... 9/2 R, 2 S, 310 E; 114/39, 219; 280/18

[56] References Cited

U.S. PATENT DOCUMENTS

| | | | |
|---|---|---|---|
| 350,123 | 10/1886 | Ferguson | 280/18 |
| 2,593,806 | 4/1952 | Steele | 9/310 E |
| 2,741,782 | 4/1956 | Müller | 9/2 S |
| 2,776,637 | 1/1957 | Chadwick | 114/219 |
| 2,927,799 | 3/1960 | Schnitzler | 280/18 |
| 2,944,505 | 7/1960 | Berge | 114/39 |
| 3,273,528 | 9/1966 | Kiefer | 9/310 E |
| 3,374,495 | 3/1968 | Joyce | 9/310 E |
| 3,409,920 | 11/1968 | Brownley | 9/310 E |
| 3,455,261 | 7/1969 | Perrin | 9/310 E |
| 3,996,868 | 12/1976 | Schagen | 9/310 E |

*Primary Examiner*—Trygve M. Blix
*Assistant Examiner*—D. W. Keen
*Attorney, Agent, or Firm*—Armstrong, Nikaido, Marmelstein & Kubovcik

[57] ABSTRACT

A sailboard having an unstayed rig comprises a mast mounted by a universal joint on a surfboard having a retractable keel. A sail having a neck and a lower bolt-rope is attached between the mast and nocks of spars fixed to the mast for the retention and adjustment of the mast and sail. The lower bolt-rope of the sail extends from the nocks of the spars to the mast at a downward inclination, the spars being fixed to the mast above the neck of the sail. The surfboard is provided with a coupling portion for coupling to a similar surfboard by a coupling member to form a composite surfer.

18 Claims, 26 Drawing Figures

Fig.10
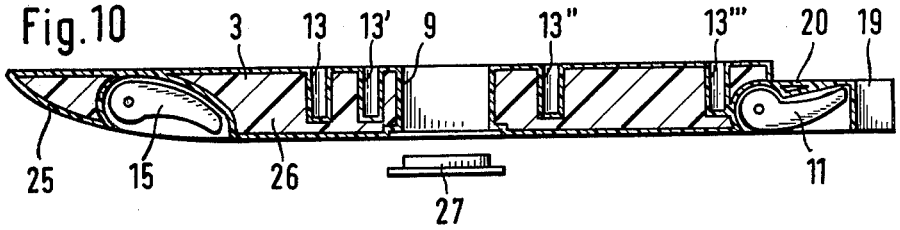
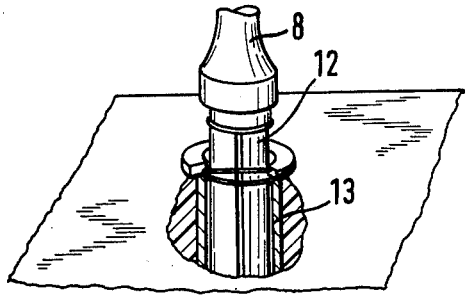
Fig.11
Fig.12
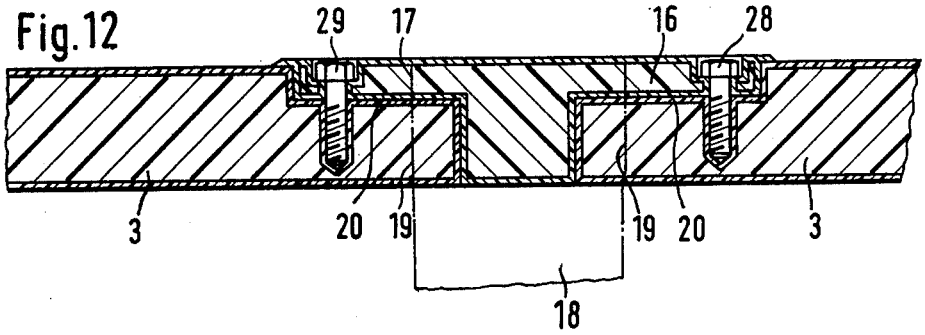
Fig.13
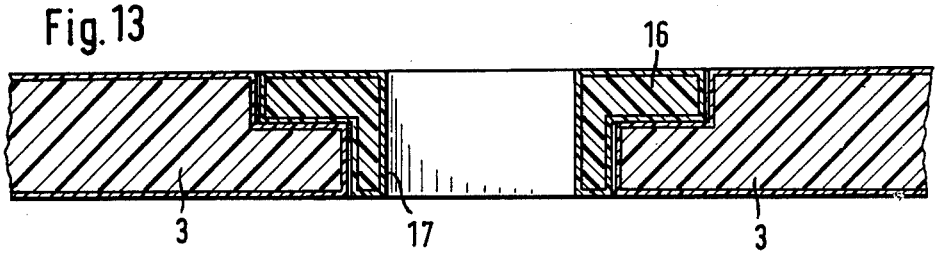

SURFBOARD

BACKGROUND OF THE INVENTION

The invention relates to a sailboard or wind surfer having an unstayed rig, which sailboard comprises a mast connected to a surfboard via a joint movable on all sides without substantial resistance and spars, the sail being attached between the mast and the nocks of the spars used for the retention and adjustment of the mast and sail, the lower bolt-rope of the sail extending from the nocks at an inclination downwards to the mast, and the spars being fixed to the mast above the neck of the sail, the surfboard having a retractable keel and, if necessary, on the stern a further keel device, preferably a fin. In principle, sailboards of this kind have been known for many years. ("Popular Science," August 1965, Pages 138 - 141, and U.S. Pat. No. 3,487,800).

Normally sailboards of the kind specified are sailed by one person with one sail. So-called tandem surfers, which are about twice as long as a single sailboard, are also known and are controlled with two sails by two persons standing one behind the other. However, these tandem surfers are about 7 to 8 m in length and therefore very clumsy for transportation. Moreover, the prior art tandem surfers are not nearly suited to all possible kinds of wind surfing. As a rule the prior art wind surfers or sailboards are made of foamed plastics with a hard outer skin. Sailboards made of wood also form part of the prior art.

It is an object of the invention to provide an improved sailboard so as to eliminate problems of transportation and handling and to enable a tandem surfer affording new sporting possibilities to be formed from identical sailboards by very simple means.

SUMMARY OF THE INVENTION

To this end, in a sailboard of the kind specified, there is provided on the surfboard a coupling portion at which two identical surfboards can be coupled to one another so as to form a composite surfer and a coupling member is provided for interconnecting the two surfboards.

In one particularly preferred embodiment of the invention, the coupling portion is so disposed on the stern of the surfboard that two surfboards can be coupled stern to stern. This more particularly affords the advantage that the sailboard can optionally be sailed as an individual board while at the same time offering the possibility of forming a tandem surfer by coupling two separate sailboards, an additional advantage being that the resulting tandem surfer has two bow tips. Consequently, unlike conventional sailing boats, no tack is required to change direction, the tandem surfer constructed according to the invention merely changing its sailing direction instead.

Due to the considerable length of a tandem surfer made up of two sailboards in accordance with the invention, advantageously the coupling portion is so constructed as to have a limited resilience. Preferably, the coupling member is made of a tough resilient material.

In a possible alternative embodiment the coupling portion can be formed by one or more flexible members.

According to another alternative, the coupling member comprises springs pressing the ends of the surfboards against one another.

According to another possible feature of the invention, the ends of the surfboards are made of the tough resilient material and can be interconnected via attaching means, and the ends of the surfboards are formed with a central slot which forms the keel box for the resulting tandem surfer when the surboards are interconnected.

In a further embodiment of the invention, the coupling member has a cross-section corresponding to the cross-section of the surfboard and at least partially contains the keel box of the tandem surfer when formed.

BRIEF DESCRIPTION OF THE DRAWINGS

The invention will now be described in greater detail with reference to embodiments illustrated by way of example in the drawings, wherein:

FIG. 10 is a diagrammatic longitudinal sectional view of a surfboard, showing advantageous details of a sailboard embodying the invention;

FIG. 11 is a perspective, partially sectioned side elevation of a connection for the universal joint of a mast foot;

FIG. 12 is a sectional view of a further embodiment of the coupling portion of a sailboard;

FIG. 13 is a view like FIG. 12 of a further embodiment of the coupling portion;

DESCRIPTION OF PREFERRED EMBODIMENTS

Figure 1:
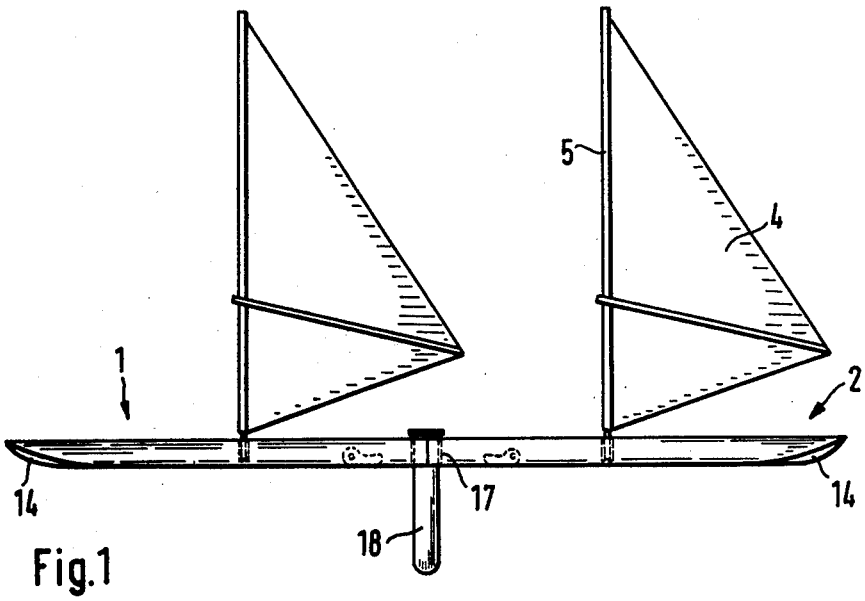
FIG. 1 is a diagrammatic side elevation of two sailboards embodying the invention coupled together.

FIG. 1 shows two identical sailboards or wind surfers 1, 2 coupled to one another stern to stern to form a tandem surfer. The basic components of a single sailboard are illustrated diagrammatically in FIG. 2. A sailboard of this kind consists of a surfboard 3 and sail 4. The sail 4 is attached to a mast 5 on which a boom 6 is so fixed that the lower bolt-rope 7 of the sail 4 extends from the nocks of the boom 6 at an inclination downwards to the mast. As in the prior art embodiments of sailboards, the boom 6 takes the form of a double forked boom (wishbone), so that the boom 6 can be seized and adjusted from both sides of the sail. The mast 5 is connected to the surfboard 3 by a universal joint 8, so that the mast can be moved freely in every direction, while nevertheless the connection between the mast and the surfboard remains preserved. The surfboard 3 also has a keel box 9 receiving a keel 10. Also disposed on the stern of the surfboard 3 is a fin 11 which can be hinged upwardly in the preferred embodiment of the invention. The joint 8 is connected to a member 12 which forms the mast foot and is received by connections 13 provided in the surfboard.

Figure 3:
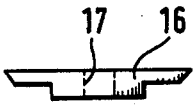
FIG. 3 is a diagrammatic illustration of a coupling member.
Figure 2:
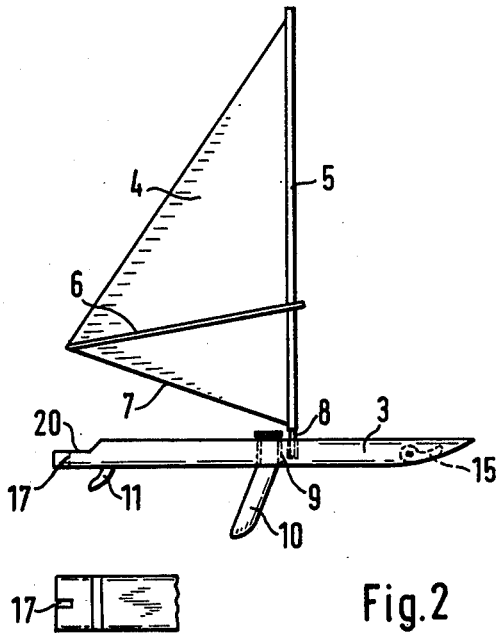
FIG. 2 is a side elevation of one of the sailboards illustrated in FIG. 1.

The surfboard 3 diagrammatically illustrated in FIGS. 1–3 also has in the bow region another keel device which can take the form of a rib 14 (FIG. 1) or a hinged retractable fin 15 (FIG. 2).

FIG. 3 is a diagrammatic view of the basic construction of a coupling member of tough resilient material. The coupling member 16 has a keel box 17 which at least partially receives the keel 18 of a tandem surfer formed by connecting two individual sailboards with the member 16. As shown in FIG. 2, a recess 17 can also be provided at the stern of each individual surfboard 3 to enable the keel 18 to be inserted and at the same time ensure lateral stability when the sailboards 1, 2 are coupled to one another.

A stepped zone 20 of the surfboard 3 shown in FIG. 2 is called the coupling portion and is used for the reception and attachment of the coupling member 16.

Figure 4:
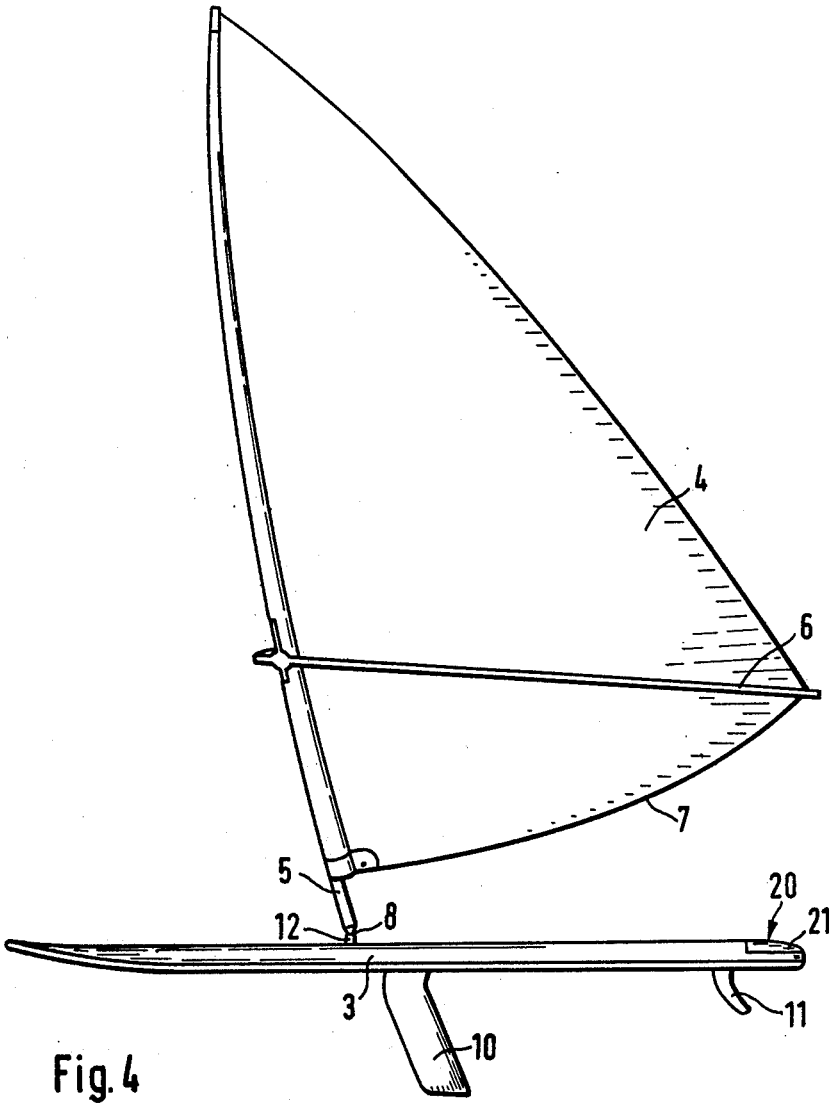
FIG. 4 is a detailed side elevation of a single sailboard.

FIG. 4 is a side elevation showing further details of a sailboard or of the kind described hereinbefore; the embodiment illustrated in FIG. 4 has a cover portion 21 over the coupling zone 20 in case a sailboard of this kind is used individually.

Figure 5:
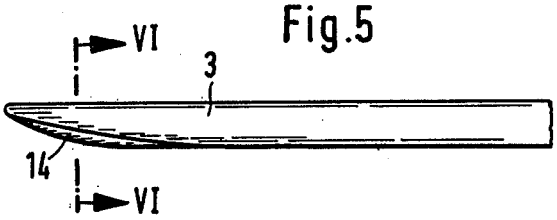
FIG. 5 is a side elevation of a first embodiment of the bow of a single sailboard.
Figure 6:
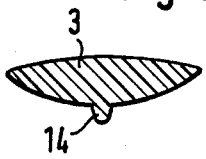
FIG. 6 is a section, taken on the line VI—VI in FIG. 5.

FIGS. 5 and 6 show in further detail a first embodiment of a keel device provided at the bow of a sailboard embodying the invention and in this case taking the form of a rib or keel portion 14.

Figure 7:
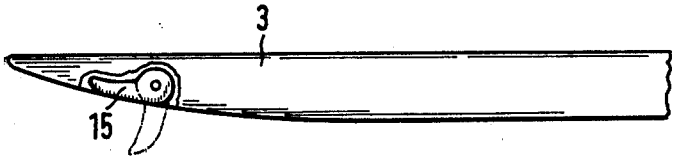
FIG. 7 is a diagrammatic partially sectioned side elevation of a further embodiment of the bow of a single sailboard.

FIG. 7 shows a variant embodiment of a surfboard 3 on which the keel device takes the form of a hinged retractable fin 15.

When two sailboards 1, 2 are coupled to one another, the rib 14 or fin 15 performs the function of the fin 11 of an individual sailboard, since it ensures extra lateral guidance of the tandem surfer formed. Since the tandem surfer formed by two sailboards embodying the invention can be sailed both forward and in reverse, the embodiment illustrated in FIGS. 5 and 6 seems especially advantageous, since no separate adjustment has to be made. Since moreover sailboards of this kind very easily start to slide, the bow rising out of the water, the fin on the bows is no hindrance whatever either during forward sailing or when an individual sailboard is used.

Figure 8:
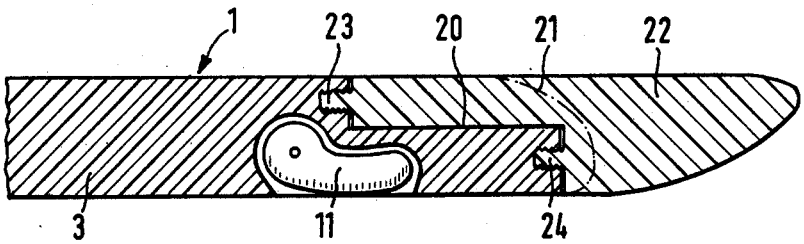
FIG. 8 is a sectional side elevation of the stern of a single sailboard with the coupling portion and a stern extension coupled thereto.

FIG. 8 is a sectional side elevation of the stern zone of a sailboard 1 showing the stern fin 11 in the upwardly hinged position, as when the sailboards 1, 2 are sailed coupled to one another. For use an an individual sailboard, coupled on in the coupling zone 20 of the surfboard 3 is a stern extension 22 which, for example, has pins engaging by a press fit in bores 23, 24 in the stern of the surfboard 3. FIG. 8 also shows in chain lines the cover portion 21 of the coupling zone 20 in the embodiment illustrated in FIG. 4, which can be similarly connected to the surfboard 3.

Figure 9:
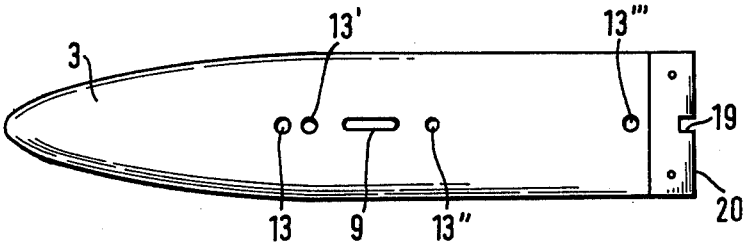
FIG. 9 is a plan view of the surfboard of a sailboard embodying the invention.

FIG. 9 is a plan view of a sailboard embodying the invention, showing the position of the various connections 13 for the foot 12 of the mast 5. The connections comprise two connections 13, 13′ which are disposed one behind the other forward of the keel box 9 and enable the mast foot to adopt various positions during individual surfing, to achieve optimum trim. Disposed aft of the keel box 9 is a further connection 13″ which receives the mast foot 12 when two sailboards are coupled to one another and during use as a tandem surfer with two rigs. A further connection 13‴ is provided adjacent the coupling portion 20, so that two surfboards 3 coupled to one another can be sailed by one person using a single rig.

FIG. 10 is a diagrammatic sectional side elevation again summarizing the details by which a sailboard according to the invention differs from prior art sailboards. FIG. 10 also shows how the surfboard, usually made of plastics, has a comparatively hard, impact-resistant shell 25 enclosing foamed plastics 26 inside. FIG. 10 further shows a cover 27 by means of which the keel box 9 of the individual sailboard 3 can be closed from below, when two sailboards are coupled to one another to form a tandem surfer.

FIG. 11 shows details of the construction of the connections 13 for receiving the mast foot 12, although these do not form part of the invention.

FIG. 12 is a sectional view showing two surfboards 3 connected stern to stern by means of a coupling member 16. The coupling member 16 is connected to the surfboards 3 via screws 28, 29 or the like and partly forms the keel box 17 for a tandem surfer, the keel 18 of the tandem surfer in this case being also guided through recesses 19 in the coupling zone 20 of the interconnected surfboards.

FIG. 13 is a sectional view similar to FIG. 12, but taken in a different sectional plane, the difference from the embodiment illustrated in FIG. 12 being that the keel box 17 is completely formed in the coupling member 16.

Figure 14:
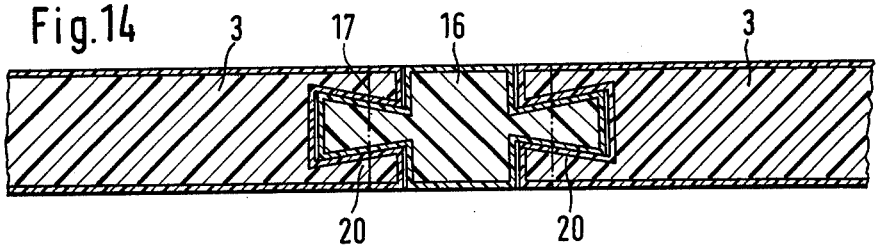
FIG. 14 is a view like FIG. 12 of a further embodiment of the coupling portion.

In the embodiment illustrated in FIG. 14 the coupling member is formed by a dovetailed shaped member which slots into corresponding mortices in the coupling zones 20 of the surfboards 3 to connect the zones 20 positively to one another. The coupling member 16 is inserted from the side of the surfboards 3 and again partly forms the keel box 17 of the tandem surfer.

Figure 15:
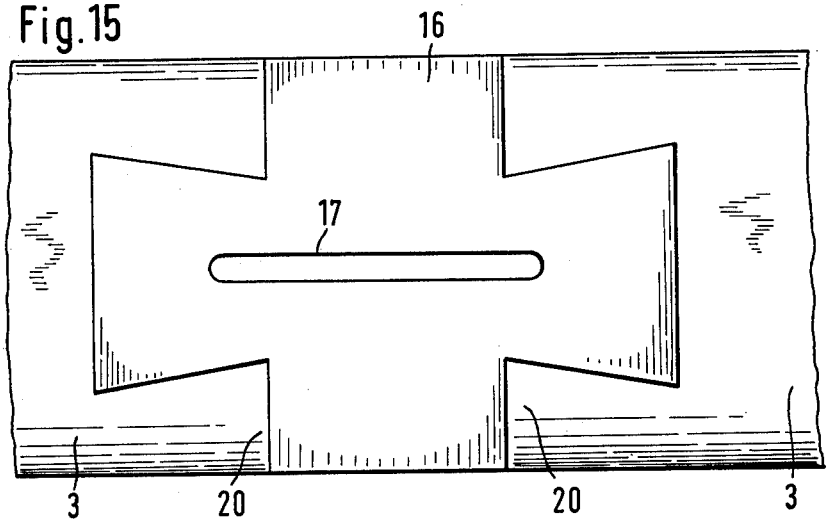
FIG. 15 is a plan view of another embodiment of the coupling portion.

In the embodiment of which a plan view is shown in FIG. 15, the coupling member 16 again takes the form of a member which interconnects positively the coupling zones 20 of the surfboards 3 but which in this case is inserted from above into the coupling zones 20 of the surfboards 3 and contains the whole of the keel box 17 for the keel 18 of the tandem surfer.

Figure 16:
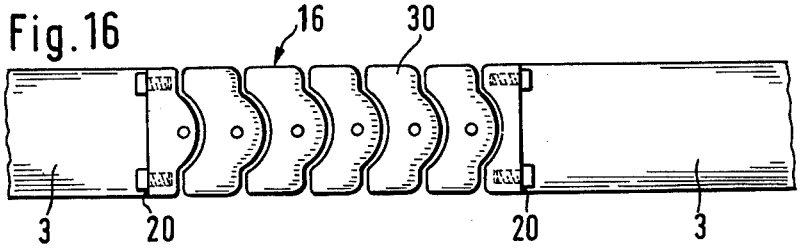
FIG. 16 is a side elevation of a further embodiment of the coupling portion.

FIG. 16 is a side elevation of an articulated coupling member 16 built up of members 30 coupled together with provision for limited relative movement, the coupling member 3 being fixed via screws or similar attaching means to the coupling zones 20 of the surfboards 3.

It should be pointed out that due to the considerable length of the tandem surfer formed by two sailboards, in all the embodiments of the coupling member there must be a certain resilience at the connecting place, to prevent the completed tandem surfer from breaking apart. To this end the coupling member 16 is either made of a tough resilient material or formed directly as a flexible member, as in the embodiment illustrated in FIG. 16.

Figure 17:
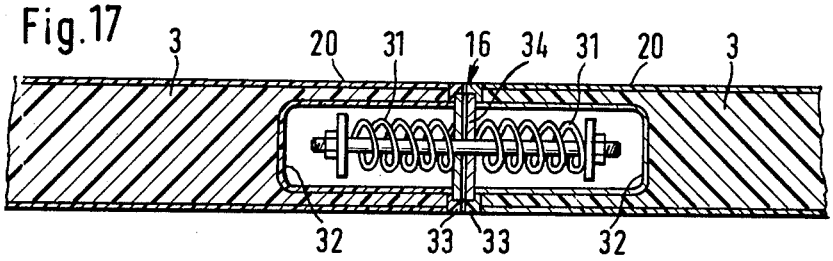
FIG. 17 is a sectional view of a variant embodiment of a coupling portion.

FIG. 17 illustrates an embodiment of the coupling member 16 in which resilience is ensured by two springs 31 which press the sterns of the sailboards 3 against one another and are received in recesses 32 in the coupling zone 20 of the surfboards. Also provided on the sterns of the surfboards 3 are respective strips 33 of a tough resilient material which enable the surfboards 3 to move against one another without damage. In the embodiment illustrated the springs 31 bear against metal plates 34 and press the two surfboards 3 against one another with a pressure such that movement of the surfboards apart takes place only under considerable loadings.

Figure 18:
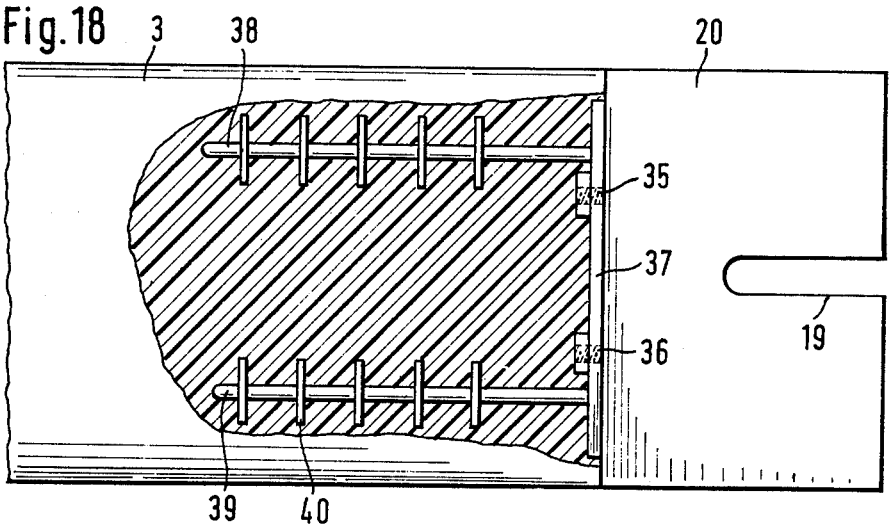
FIGS. 18 and 19 are sectional plan views and side elevations respectively of details of the coupling portion.
Figure 19:
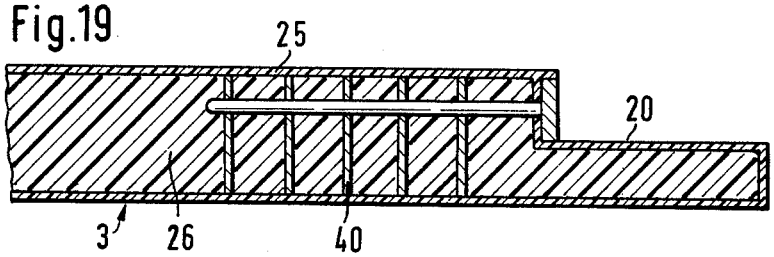

FIGS. 18 and 19 show details of a possible way of connecting the coupling members 16 by means of screws or other attaching means; the embodiment illustrated in FIGS. 18 and 19 is advantageous, since the foamed core 26 of such surfboards is normally too weak to take the required stress due to the considerable overall length of the tandem surfer. Consequently in the embodiment illustrated the screwed connections 35, 36 or the like for the connecting means to the coupling members 16 are formed in a middle plate 37 and are connected via tie-rods 38, 39 and plates 40 on the one hand to the foamed core 26 and on the other to the hard outer shell 25 of the surfboard 3. The tierods 38, 39 and the plates 40 are preferably made of aluminium. However, it is particularly important to ensure a satisfactory connection between the plates 40 and the hard outer shell 25, so that the loads occurring are transmitted to the most stable zone of the surfboard 3.

Figure 20:
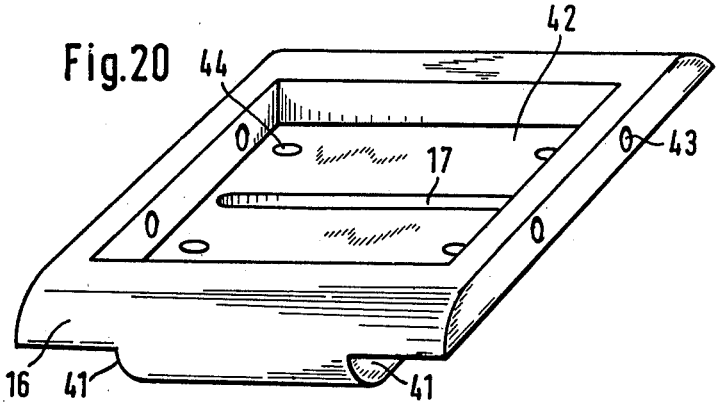
FIG. 20 is a perspective view of an embodiment of the coupling portion.

FIG. 20 is a perspective view of a coupling member 16 such as can, for instance, be connected to the surfboard of FIG. 9 to couple two such surfboards to one another. The coupling members 16 shown in FIG. 20, whose cross-section corresponds to the cross-section of the surfboard 3, has two steps 41 which extend over its width and whose dimensions correspond to the stepping of the surfboard 3 in the zone of the coupling portion 20. On its upper surface the coupling member 16 shown in FIG. 20 has a depression 42 which forms the access to bores or apertures 43, 44 by means of which the coupling member 16 is connected via attaching means (not shown) to the coupling portion 20 of the surfboards 3. Disposed in the bottom of the depression 42 is the keel box 17 for the keel 18 of the completed tandem surfer. In this embodiment the keel 18 of the tandem surfer preferably has an enlarged head zone whose dimensions substantially correspond to the dimensions of the depression 42, so that a smooth surface is again produced when the keel is inserted. Instead of the enlarged head zone, a cover plate (not shown) can be inserted in the depression 42, the cover plate having a slot corresponding to the keel box 17, so that the keel 18 can be partly or completely retracted to correspond to the sailing conditions.

Figure 21:
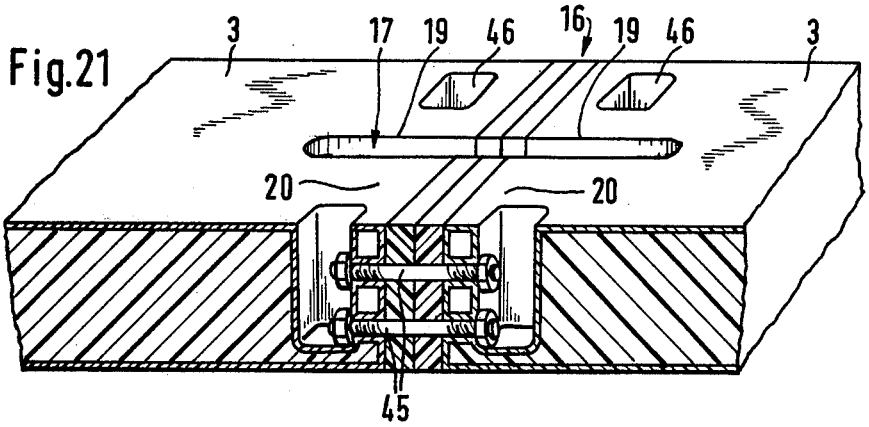
FIG. 21 shows another way of coupling the two surfboard ends.

FIG. 21 shows a further variant of the connection between two sailboards to form a tandem surfer. As illustrated, in this case the majority of the keel box 17 is formed by the slots 19 in the coupling portion 20 of the surfboards 3. In this embodiment the coupling member 16 is constructed in two parts, each part, which is made of a tough resilient material to limit the mobility of this zone, is disposed on the side of the keel box 17. Each of the two components of the coupling member 16 comprises one or two plates of the tough resilient material, into which screws 45 are cast or which are attached in some other way. Disposed in the coupling portion 20 of the surfboards 3 at a distance from the rear edge are vertical depressions 46 having bores in the rear wall corresponding to the screws 45. To couple two surfboards 3 together, the projecting ends of the screws 45 are inserted on both sides through the bores in the rear wall of the apertures 46 and secured from the direction of the apertures 46 by nuts or the like, so that the result again is a semi-rigid connection. Alternatively, the two plates of tough resilient material on both sides of the keel box 17 can form a component of the surfboard 3, so that all that has to be done is to insert the screws 45 to couple two surfboards 3 to one another.

Figure 22:
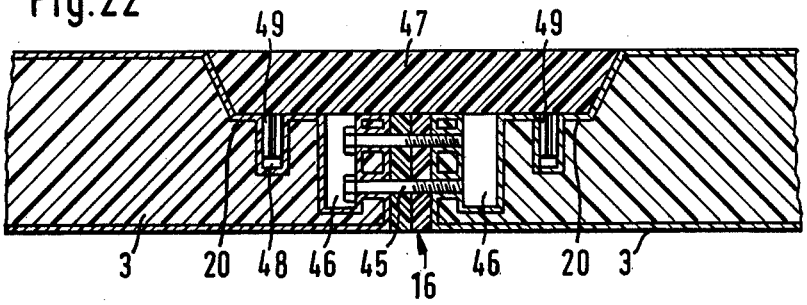
FIG. 22 shows another embodiment of a coupling portion.

The embodiment illustrated in FIG. 22 differs from that illustrated in FIG. 21 by the feature that the construction of the coupling member 16 described in relation to the FIG. 21 embodiment is disposed in the stepping at the stern of the surfboard. In the embodiment illustrated in FIG. 22 the coupling member 16 is then completed by an insert member 47 which fills the space formed by the two steps at the stern of the surfboards 3 and contributes towards the security of the connection. The insert member 47 can be connected to the two surfboards 3 via a simple pin connection with a clamp fit. To this end the coupling portion 20 of the surfboards 3 are formed with corresponding sleeve-like depressions 48 in which preferably pins 49, constructed in the form of slotted sleeves, of the insert member 47 engage.

Figure 23:
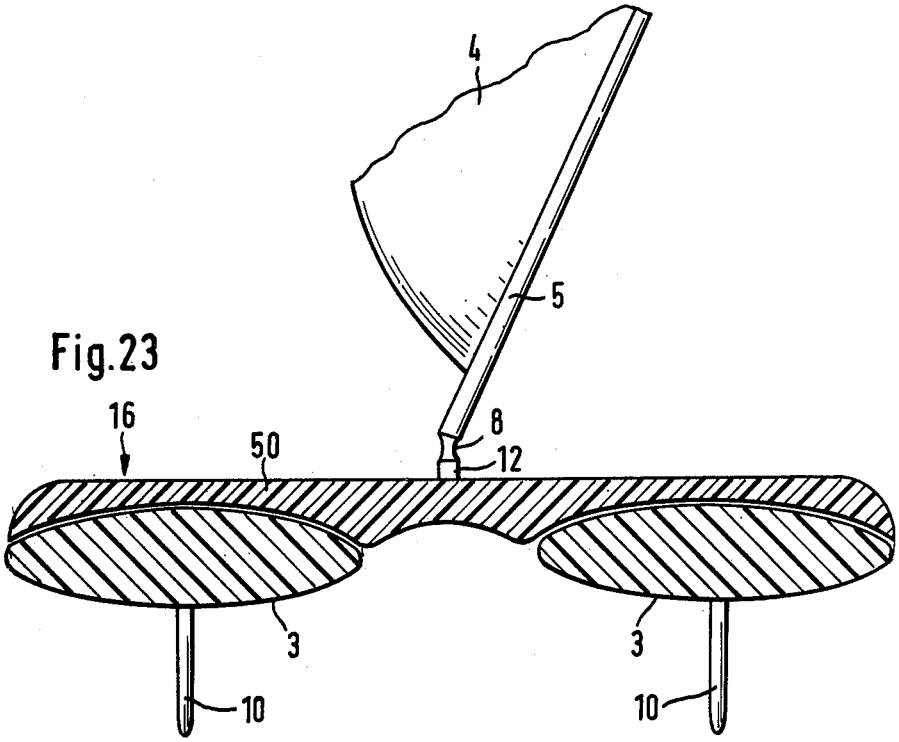
FIG. 23 is a partially sectioned front view of a further embodiment of the invention, in which two sailboards are coupled to one another via a bridge-like coupling member.

FIG. 23 illustrates another basically different kind of connection between surfboards 3, which in this case are coupled to one another via a bridge-like construction on member 50 to form a structure like a catamaran. The bridge-like constructional member 50 can be connected to the surfboards 3 via pins (not shown) corresponding to the construction of the mast foot 12, using the connections 13, 13′, 13″ and if necessary 13‴ provided in the surfboards 3, or extra attaching devices (not shown) can be provided. In this case also the bridge-like constructional member 50 has corresponding connections 13 for the foot 12 of the mast 5 with sail 4, and the catamaran-like tandem surfer produced in this way can be sailed by a single person.

Figure 24:
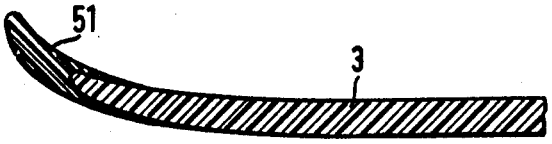
FIG. 24 is a sectional view of the bow area of a sailboard with a bow attachment.

FIG. 24 is another diagrammatic sectioned side elevation of a surfboard 3 with a wave-breaking bow attachment, which can be advantageous due to the high speeds which tandem surfers can reach. Since it hardly has to absorb any loads, the attachment 51 can be connected to the bow of the surfboard via a simple positive connection.

Figure 25:
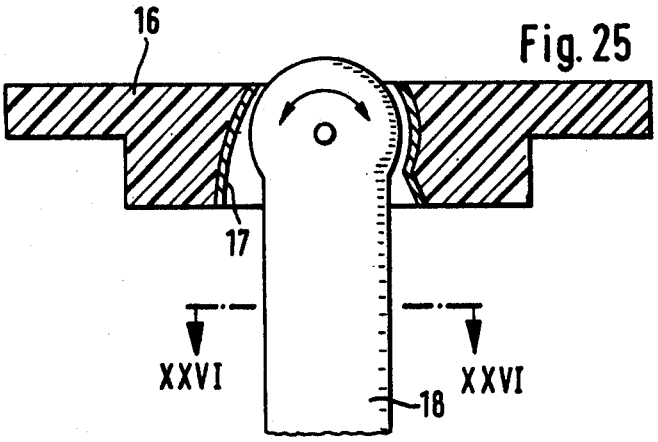
FIG. 25 is a lateral sectional view of a coupling portion with a retractable keel mounted therein.

FIG. 25 illustrates an embodiment of the coupling member 16 in which the keel 18 for the tandem surfer is a component of the coupling member 16 and is mounted with provision for pivoting in both directions in the keel box 17. As a result, for each selected direction of sailing of the tandem surfer the keel 18 can be pivoted into the optimum, slightly backwardly inclined position, and this can be done from the top of the coupling member 16.

Figure 26:
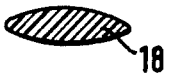
FIG. 26 is a section taken along the line XXVI—XXVI in FIG. 25.

Since the tandem surfer can be sailed in both directions — i.e., forward and in reverse — advantageously the keel 18 is profiled on both sides for both sailing directions, as shown in FIG. 26.

For the sake of completeness it should be pointed out that the completed tandem surfer made up of two sailboards 1, 2 can also have extra connections 13 for mast feet 12, so that the tandem surfer can be sailed if necessary with three or even four rigs.

I claim:

1. A sailboard having an unstayed rig, said sailboard comprising: a surfboard having a keel box and a retractable keel; a mast; a universal joint mounting said mast on said surfboard; a sail having a neck and a lower bolt-rope; spars having nocks and fixed to the mast for the retention and adjustment of said mast and sail, said sail being attached between said mast and the nocks of said spars, the lower bolt-rope of said sail extending from the nocks of said spars to said mast at a downward inclination, said spars being fixed to said mast above the neck of said sail; wherein said surfboard is provided with a coupling portion for coupling said surfboard to a similar surfboard by a flexible coupling means to form a composite surfer, said coupling means allowing relative movement of said coupled surfboards, said coupling portions being disposed at the stern of each said surfboard for coupling said surfboards stern to stern, to form a tandem surfer.

2. A sailboard as claimed in claim 1, wherein said coupling means is made of a tough resilient material.

3. A sailboard as claimed in claim 1, wherein said coupling means comprises a plurality of articulated members.

4. A sailboard as claimed in claim 1, wherein said coupling means comprises springs for resiliently pressing the sterns of said surfboards against one another.

5. A sailboard as claimed in claim 1, wherein a stern portion of said surfboard is made of tough resilient material for coupling to the stern of said similar surfboard by attaching means, the stern of said surfboard being formed with a central longitudinally extending slot forming with a corresponding slot of said similar surfboard a keel box of the resulting tandem surfer when the surfboards are coupled together.

6. A sailboard as claimed in claim 1, wherein said coupling means has a cross-section corresponding to the cross-section of said surfboard and at least partially contains the keel box for a tandem surfer formed by said surfboard and said similar surfboard.

7. A sailboard as claimed in claim 1, wherein said coupling means is attached to said surfboard by fastening means.

8. A sailboard as claimed in claim 1, wherein said coupling means is shaped for interlocking engagement with a complementary portion of said surfboard.

9. A sailboard as claimed in claim 1, wherein said surfboard has at least two connections for said universal joint, one of said connections being located forward of the keel box of said surfboard and another aft of said keel box.

10. A sailboard as claimed in claim 9, wherein a further connection for said universal joint is provided on one of said surfboard and said coupling member.

11. A sailboard as claimed in claim 1, wherein a keel-like device is provided on said surfboard at the bow thereof.

12. A sailboard as claimed in claim 11, wherein said keel-like device is a rib moulded on said surfboard.

13. A sailboard as claimed in claim 11, wherein said keel-like device is a hinged, retractable fin.

14. A sailboard as claimed in claim 1, wherein a hinged retractable fin is provided at the stern of the surfboard.

15. A sailboard as claimed in claim 1, wherein a cover member is provided for the coupling portion of said surfboard for use when the sailboard is used as a single sailboard.

16. A sailboard as claimed in claim 1, wherein a wave-breaking bow attachment is coupled to the bow of the surfboard.

17. A sailboard as claimed in claim 1 including a keel for the tandem surfer, said keel having a double profile and being pivotable for use in forward and reverse sailing.

18. A sailboard as claimed in claim 1, wherein said surfboard has connections for said universal joint, the coupling portion of said surfboard being constituted by the keel box and said joint connections, the coupling means being a bridge-like member for coupling said surfboard in parallel with said similar surfboard.

* * * * *